US005434651A

United States Patent [19]

Aizawa et al.

[11] Patent Number: 5,434,651

[45] Date of Patent: Jul. 18, 1995

[54] IMAGE FORMING APPARATUS AND A CHARGING DEVICE

[75] Inventors: Masahiro Aizawa, Takatsuki; Noboru Katakabe, Uji, both of Japan

[73] Assignee: Matsushita Electric Industrial Co., Ltd., Kadoma, Japan

[21] Appl. No.: 126,909

[22] Filed: Sep. 24, 1993

[30] Foreign Application Priority Data

| | | | |
|---|---|---|---|
| Sep. 28, 1992 | [JP] | Japan | 4-258163 |
| Sep. 28, 1992 | [JP] | Japan | 4-258165 |
| Sep. 28, 1992 | [JP] | Japan | 4-258166 |
| Sep. 28, 1992 | [JP] | Japan | 4-258167 |
| Sep. 28, 1992 | [JP] | Japan | 4-258179 |

[51] Int. Cl.[6] ..... G03G 15/00

[52] U.S. Cl. ..... 355/210; 355/219; 355/245; 347/158

[58] Field of Search ..... 355/296, 298, 269, 270, 355/247–249, 261–262, 265, 251, 253, 210, 245, 219; 430/55; 118/647, 652, 653–655, 657; 346/153.1, 74.3, 74.2; 361/225, 226, 230

[56] References Cited

U.S. PATENT DOCUMENTS

| | | | |
|---|---|---|---|
| 2,979,403 | 4/1961 | Giaimo, Jr. | 118/647 X |
| 3,696,784 | 10/1972 | Benson | 355/254 X |
| 3,739,749 | 6/1973 | Kangas et al. | 118/652 X |
| 3,826,672 | 7/1974 | Cantarano | 355/265 X |
| 3,890,039 | 6/1975 | Cantarano | 355/247 X |
| 3,910,231 | 10/1975 | Inoue et al. | 118/652 X |
| 3,993,022 | 11/1976 | Zimmer | 118/652 |
| 4,015,561 | 4/1977 | Howard et al. | 118/657 X |
| 4,077,711 | 3/1978 | Akamatsu | 118/652 X |
| 4,292,387 | 9/1981 | Kanbe et al. | 430/102 |
| 4,395,476 | 7/1983 | Kanbe et al. | 430/102 |
| 4,402,000 | 8/1983 | Fabel et al. | 346/153.1 X |
| 4,473,627 | 9/1984 | Kanbe et al. | 430/102 |
| 4,482,241 | 11/1984 | Moraw et al. | 355/296 X |
| 4,701,042 | 10/1987 | Mimura et al. | 355/265 |
| 4,763,143 | 8/1988 | Ohba et al. | 346/153.1 X |
| 4,768,060 | 8/1988 | Landa et al. | 355/261 X |
| 4,873,540 | 10/1989 | Asanae et al. | 346/153.1 X |
| 4,918,487 | 4/1990 | Coulter, Jr. | 355/261 X |
| 5,023,665 | 6/1991 | Gundlach | 355/296 X |
| 5,025,290 | 6/1991 | Landa et al. | 355/265 |
| 5,153,616 | 10/1992 | Asanae et al. | 346/153.1 |

FOREIGN PATENT DOCUMENTS

| | | |
|---|---|---|
| 48-22211 | 7/1973 | Japan . |
| 58-32375 | 7/1983 | Japan . |
| 59-8831 | 2/1984 | Japan . |
| 63-13183 | 3/1988 | Japan . |
| 63-16736 | 4/1988 | Japan . |
| 63-42256 | 8/1988 | Japan . |
| 63-42782 | 8/1988 | Japan . |
| 64-1013 | 1/1989 | Japan . |
| 131605 | 6/1989 | Japan . |
| 131606 | 6/1989 | Japan . |

*Primary Examiner*—Matthew S. Smith
*Attorney, Agent, or Firm*—Renner, Otto, Boisselle & Sklar

[57] ABSTRACT

An image forming apparatus including a latent image carrying member moving while carrying an electrostatic latent image on a surface thereof; a developer supplying member for supplying a developer to a whole electrostatic latent image on the surface of the latent image carrying member including an image area and a non-image area; a charging member for charging the developer on the surface of the latent image carrying member; and a developer recovering member for recovering a portion of the developer adhering to the non-image area of the surface of the latent image carrying member.

15 Claims, 3 Drawing Sheets

IMAGE FORMING APPARATUS AND A CHARGING DEVICE

BACKGROUND OF THE INVENTION

1. Field of the Invention

The present invention relates to an image forming apparatus for use in a printer, a copier, a facsimile apparatus and the like, and a charging device for a developer usable in such an image forming apparatus.

2. Description of the Related Art

Developing methods which have conventionally been used for an image forming apparatus include a cascade method, a touch-down method and a jumping method.

Various improvements have been made for these methods in order to improve the reproducibility and clarity of an image.

In a conventional structure, a developer carrier for carrying and supplying the developer is located to be opposed to a latent image carrier with a specified distance therefrom, and an appropriate bias voltage is applied between the developer carrier and the latent image carrier. Improved methods using such a system are described in, for example, Japanese Patent Publication Nos. 58-32375, 63-42256, 63-42782, and 64-1013, U.S. Pat. Nos. 4,395,476, 4,473,627, and 4,792,387. The methods described in these publications are referred to as the AC jumping method and have been put into practical use.

Such a conventional AC jumping method will be described with reference to FIG. 8, which illustrates a structure for a developing area and the vicinity thereof of a conventional image forming apparatus. A developer carrier 101 and a latent image carrier 102 are arranged to be opposed to each other. The developer carrier 101 rotates in a direction of arrow A. A blade 107 for forming a developer 100 into a developer layer 103 is provided to be opposed to the developer carrier 101 with a certain distance therefrom. The latent image carrier 102 rotates in a direction of arrow B.

In the conventional AC jumping method, the developer layer 103 is formed on the developer carrier 101 by the blade 107. The developer 100 of the developer layer 103 is charged on the developer carrier 101.

A bias voltage obtained by superimposing an AC bias voltage on a DC bias voltage is applied between the developer carrier 101 and the latent image carrier 102. An alternating electric field is formed between the developer carrier 101 and an area of the latent image carrier 102 opposed to the developer carrier 101 by an AC bias component of the bias voltage. By the alternating electric field, particles of the developer 100 carried on the developer carrier 101 reciprocate between the developer carrier 101 and the latent image carrier 102. While reciprocating, the particles gradually adhere to an image area of the electrostatic latent image on the latent image carrier 102, thereby developing the image.

In order to accurately develop the latent image by the conventional AC jumping method, the particles of the developer 100 on the developer carrier 101 should be attracted accurately to an image area of the latent image carrier 102, the image area having a different potential from that of a non-image area. The particles are attracted to the image area more accurately in the case where the developer layer 103 is more uniformly charged. In order to uniformly charge the developer layer 103, it is indispensable that the developer layer 103 formed on the developer carrier 101 should have a uniform thickness.

Formation of the developer layer 103 having a uniform thickness requires special processing and a precision control mechanism. As a result, problems occur in that the image forming apparatus has a complicated structure and a large size.

The conventional AC jumping method further has the problem of "sleeve ghost" phenomenon. The sleeve ghost phenomenon will be described with reference to FIG. 8.

For example, when the particles of the developer 100 forming the developer layer 103 move to the latent image carrier 102 in order to develop an image 102*a*, a recess 106 is formed in the developer layer 103. It is impossible to fill the recess 106 by supplying additional particles of the developer 100 since the developer 100 is supplied to the developer carrier 101 as a layer by the blade 107. Accordingly, the additional particles of the developer 100 only turn the recess 106 to a concave portion 104 but do not completely fill the recess 106. When the developer 100 in such a state is supplied to the latent image carrier 102 in order to develop an image 102*b*, the image 102*b* has a portion 105 to which the developer 100 does not adhere in a sufficient amount. Such a defect which is generated by an influence from a previous cycle of development is referred to as the sleeve ghost phenomenon.

For charging the developer, a compressive friction charging method and a collision charging method are widely used.

The compressive friboelectric charging method is disclosed in, for example, Japanese Patent Publication No. 59-8831. According to the compressive friboelectric charging method, the developer on the developer carrier is compressed by the blade, and thus is exposed to friction with the developer carrier or the blade. Thus, the developer is charged. When this method is used, the surface of the developer carrier is generally formed of a conductive material in order to apply a charge to the developer.

The collision charging method more actively charges the developer on the developer carrier without using the compressive force of the blade. This method is described in, for example, Japanese Patent Publications Nos. 63-13183, 1-31605, and 1-31606. According to the collision charging method, an AC electric field is formed between the developer carrier and a charging device opposed to the developer carrier. The developer on the developer carrier passes through the area supplied with the electric field while vibrating. Such vibration causes the developer and the developer carrier to collide against each other or causes particles of the developer to collide against one another. In this method also, the surface of the developer carrier is formed of a conductive material in order to apply a charge to the developer.

In either of the above-mentioned two methods, the surface of the developer carrier is formed of a conductive material. Accordingly, the charge of the developer easily leaks through the developer carrier, after being charged by the blade or the charging member until being used for developing the electrostatic latent image. As a result, when the developer is used for development, the developer does not have a sufficient potential or is not uniformly charged. Such inconveniences prevent the image from being developed as specified, and thus lower the developing performance or thwart satisfactory transference on the paper. As the ambient humidity is raised, the charge more easily leaks and thus makes the problem serious.

Further in either of the above-mentioned two methods, the developer is supplied to the developer carrier and used for developing the electrostatic latent image only for a short period of time when the developer carrier and the latent image carrier are opposed to each other. Accordingly, the developing efficiency is too low to correspond to the recent increase in the response speed.

SUMMARY OF THE INVENTION

An image forming apparatus according to the present invention comprises: latent image carrying means moving while carrying an electrostatic latent image on a surface thereof; developer supplying means for supplying a developer to a whole electrostatic latent image on the surface of the latent image carrying means including an image area and a non-image area; charging means for charging the developer on the surface of the latent image carrying means; and developer recovering means for recovering a portion of the developer adhering to the non-image area of the surface of the latent image carrying means.

In one embodiment of the invention, the developer includes a magnetic developer; the developer supplying means includes means for forming a magentic field on and in the vicinity of the electrostatic latent image; and the developer is supplied to the whole surface of the electrostatic latent image by using the magnetic field.

In another embodiment of the invention, the charging means includes charge applying means opposed to the latent image carrying means; and the developer supplied to the whole surface of the electrostatic latent image is slid on the charge applying means to be charged.

In still another embodiment of the invention, the developer recovering means includes means for forming a DC electric field between the latent image carrying means and the developer recovering means; and the portion of the developer adhering to the non-image area is recovered by using the DC electric field.

In still another embodiment of the invention, the developer recovering means includes means for forming an AC electric field with a DC electric field superimposed between the latent image carrying means and the developer recovering means; and the portion of the developer adhering to the non-image area is recovered by using the AC electric field.

In still another embodiment of the invention, the developer recovering means includes means for forming a magnetic field between the latent image carrying means and the developer recovering means; and the portion of the developer adhering to the non-image area of the electrostatic latent image is recovered by using the magnetic field.

In still another embodiment of the invention, the charging means includes charge applying means and means for forming a vibrating electric field between the charge applying means and the latent image carrying means; and the developer supplied to the electrostatic latent image on the surface of the latent image carrying means is oscillated by the vibrating electric field between the latent image carrying means and the charge applying means.

In still another embodiment of the invention, at least a surface of the charge applying means is electrically conductive.

In still another embodiment of the invention, the charge applying means is opposed to the latent image carrying means with a specified distance therefrom.

In still another embodiment of the invention, the charge applying means is provided to be opposed to and to be in contact with the latent image carrying means and has mechanical elasticity so as to be put out of contact from the latent image carrying means when being pressed up by the developer supplied to the surface of the latent image carrying means.

In still another embodiment of the invention, the charge applying means and the latent image carrying means has a minimum distance therebetween in the range from 40 μm to 2 μm including 40 μm and 2 mm.

In still another embodiment of the invention, the charge applying means has a shape of a plate.

In still another embodiment of the invention, the developer recovering means includes roller means opposed to the latent image carrying means and means for forming an alternating electric field between the roller means and the latent image carrying means; and the developer charged on the surface of the latent image carrying means is reciprocated between the latent image carrying means and the roller means by the alternating electric field, whereby a portion of the developer adhering to the non-image area of the electrostatic latent image is recovered to the roller means.

In still another embodiment of the invention, the vibrating electric field between the charge applying means and the latent image carrying means and the alternating electric field between the roller means and the latent image carrying means are formed by an identical power source.

In still another embodiment of the invention, the developer recovering means includes roller means opposed to the latent image carrying means and means for forming an alternating electric field between the roller means and the latent image carrying means; and the developer charged on the surface of the latent image carrying means is reciprocated between the latent image carrying means and the roller means by the alternating electric field, whereby a portion of the developer adhering to the non-image area of the electrostatic latent image is recovered to the roller means.

In still another embodiment of the invention, the developer recovering means includes means for forming a magnetic field between the roller means and the latent image carrying means; and the portion of the developer adhering to the non-image area of the electrostatic latent image is recovered by using the magnetic field.

In still another embodiment of the invention, the roller means includes removing means for removing a portion of the developer which is recovered to the roller means and then is adhering to a surface of the roller means.

In still another embodiment of the invention, the roller means is rotated similarly to the latent image carrying means.

In still another embodiment of the invention, the roller means and the latent image carrying means has a specified minimum distance therebetween in the range from 100 μm to 2 mm including 100 μm and 2 mm.

In still another embodiment of the invention, the minimum distance between the developer recovering means and the latent image carrying means is larger than the minimum distance between the charging means and the latent image carrying means.

In still another embodiment of the invention, a part of the latent image carrying means, and a part of the developer recovering means and housing means form a developer accommodating means for accommodating the developer.

In still another embodiment of the invention, the charging means is included in the developer accommodating means.

In still another embodiment of the invention, the developer includes a magnetic developer; the image forming apparatus further comprises a first magnetic field forming means for forming a first magnetic field in the vicinity of the latent image carrying means and the housing means; and second magnetic field forming means for forming a second magnetic field in the vicinity of the latent image carrying means and the developer recovering means; the first magnetic field prevents the developer from leaking from the developer accommodating means through a portion proximate to the latent image carrying means and to the housing means; and the second magnetic field prevents the developer from leaking from the developer accommodating means through a portion proximate to the latent image carrying means and to the developer recovering means.

In still another embodiment of the invention, the first magnetic field forming means includes a fixed magnet included in the latent image carrying means and magnetically attracts the developer in the developing accommodating means so as to hold the developer on the surface of the latent image carrying means.

In still another embodiment of the invention, the second magnetic field forming means includes a fixed magnet included in the developer recovering means and assists the developer recovering means to recover a portion of the developer adhering to the non-image area of the electrostatic latent image.

In still another embodiment of the invention, the developer recovering means includes removing means for removing a portion of the developer adhering to the surface of the developer recovering means, the removing means being provided in the developer accommodating means.

Alternatively, a charging device according to the present invention comprises: latent image carrying means moving while carrying an electrostatic latent image on an area of a surface thereof; charging means opposed to the latent image carrying means; a power source for forming an AC electric field for charging the developer between the charging means and the latent image carrying means; and developer supplying means for supplying a developer between the charging means and the latent image carrying means.

In one embodiment of the invention, the developer includes a magnetic developer; the developer supplying means includes means for forming a magnetic field between the latent image carrying means and the charging means; and the developer is supplied between the latent image carrying means and the charging means by a magnetic attraction of the magnetic field.

In another embodiment of the invention, the developer includes a magnetic developer; and the developer supplying means includes a magnet located on a side of at least one of the latent image carrying means and the charging means, the side being opposite to a side in contact with the developer, and at least the above-mentioned one of the latent image carrying means and the charging means and the magnet are relatively moved, thereby supplying the developer between the latent image carrying means and the charging means and forcing the developer to pass therebetween.

In still another embodiment of the invention, the developer includes a magnetic developer; and the developer supplying means includes a magnet on an area of the surface of the latent image carrying means, the area being opposite to the area of the surface holding the electrostatic latent image, and the developer is held on the surface of the latent image carrying means and supplied between the latent image carrying and the charging means by movement of the latent image carrying means and made to pass therebetween.

According to an image forming apparatus of the present invention, the developer supplying means first supplies a developer to the whole area of an electrostatic latent image on a surface of the latent image carrying means. Then, the charging means charges the developer on the surface of the latent image carrying means, and the developer recovering means recovers a portion of the developer adhering to a non-image area of the electrostatic latent image.

Thus, the invention described herein makes possible the advantages of providing (1) a simple-structured and compact image forming apparatus for forming a precise, high quality image without the necessity of forming a highly uniform developer layer on a developer carrier; (2) an image forming apparatus in which no sleeve ghost phenomenon occurs; and (3) an image forming apparatus in which the developer does not leak and thus the charging level for the developer is kept high.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrating examples with reference to the accompanying drawings.

Example 1

An image forming apparatus in a first example according to the present invention will be described with reference to FIG. 1. The image forming apparatus in the first example has a basic structure according to the present invention.

Figure 1:
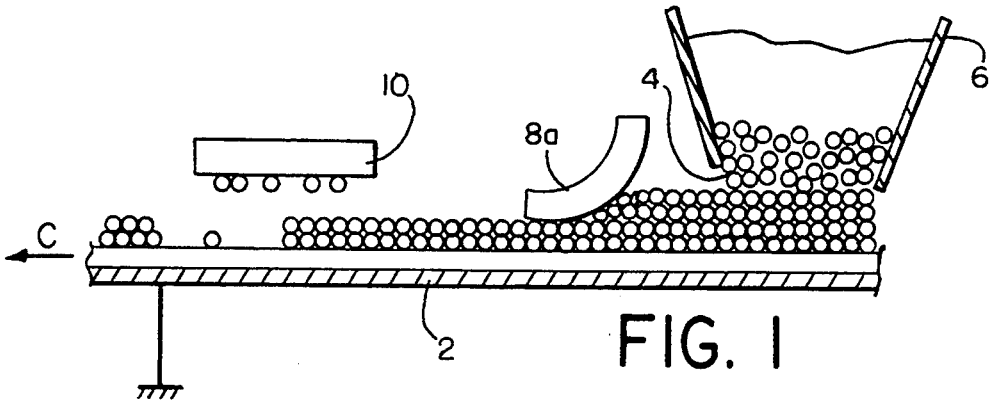
FIG. 1 is a view illustrating a basic structure for an image forming apparatus in an example according to the present invention.

As is shown in FIG. 1, the image forming apparatus includes a latent image carrier 2 for carrying an electrostatic latent image while moving in a direction of arrow C in FIG. 1, a developer container 6 accommodating a developer 4 therein, a charge applying member 8*a* for charging the developer 4, and a developer recovering member 10 for recovering an unnecessary portion of the developer 4. The developer container 6 is provided adjacent to the latent image carrier 2. The charge applying member 8*a* is located adjacent to the latent image carrier 2 with a specified distance therefrom and downstream with respect to the developer container 6. The distance between the charge applying member 8*a* and the latent image carrier 2 is larger at an upstream side, namely, the side of the developer container 6 than a downstream side. The developer recovering member 10 is provided adjacent to the latent image carrier 2 with a specified distance therefrom and downstream with respect to the charge applying member 8*a*. The developer 4 is formed of a monocomponent developer.

The image forming apparatus is operated in the following manner.

The developer container 6 supplies the developer 4 to a surface of the latent image carrier 2, both to an image area and a non-image area, utilizing a weight of the developer 4. As the latent image carrier 2 moves in the direction shown in FIG. 1, the charge applying member 8*a* slides on particles of the developer 4 carrier on the surface of the latent image carrier 2, thereby charging the developer 4. The latent image carrier 2 then passes below the developer recovering member 10 while carrying the developer 4. Using the difference in potential between the image area and the non-image area, the particles of the developer 4 adhering to the non-image area are recovered by the developer recovering member 10, thereby developing the electrostatic latent image on the latent image carrier 2.

In this example, since the developer 4 can be supplied to the latent image carrier 2 using gravity, the developer 4 can be provided in a necessary amount over the whole surface of the electrostatic latent image. Thus, the problem of defective development caused by an insufficient amount of the developer is solved. Accordingly, since it is not necessary to form a highly uniform developer layer on a developer carrier, the structure of the apparatus of the present invention is simple and the size thereof is small.

In this example, since the developer 4 is charged on the surface of the latent image carrier 2, the charging efficiency is high with little charge being leaked. Such a high charging efficiency is realized because the surface of the latent image carrier 2 is formed of a highly insulating material in order to prevent charge leaks.

In the case when an electrostatic latent image is formed by, for example, the Carlson process, after charging the surface of the latent image carrier which is formed of a photoconductive layer on a conductive base, the charged surface of the latent image carrier is irradiated with light having a pattern corresponding to an image pattern to be formed. Alternatively, an electrostatic latent image is formed by flowing ion on the surface of the latent image carrier which is formed of a dielectric layer on a conductive base, the ion having a pattern corresponding to an image pattern to be formed.

In the case when the developer 4 is charged on the surface of the latent image carrier 2 as in this example, the developing efficiency is high because the charge of the developer 4 immediately acts on the electrostatic latent image on the latent image carrier 2 so as to start developing the latent image.

Since the developer 4 is sufficiently charged by the charge applying member 8*a*, recovery of unnecessary particles is performed so that the particles of the developer 4 are left on the latent image carrier 2 exactly in correspondence with the image area of the electrostatic latent image.

Example 2

Figure 2:
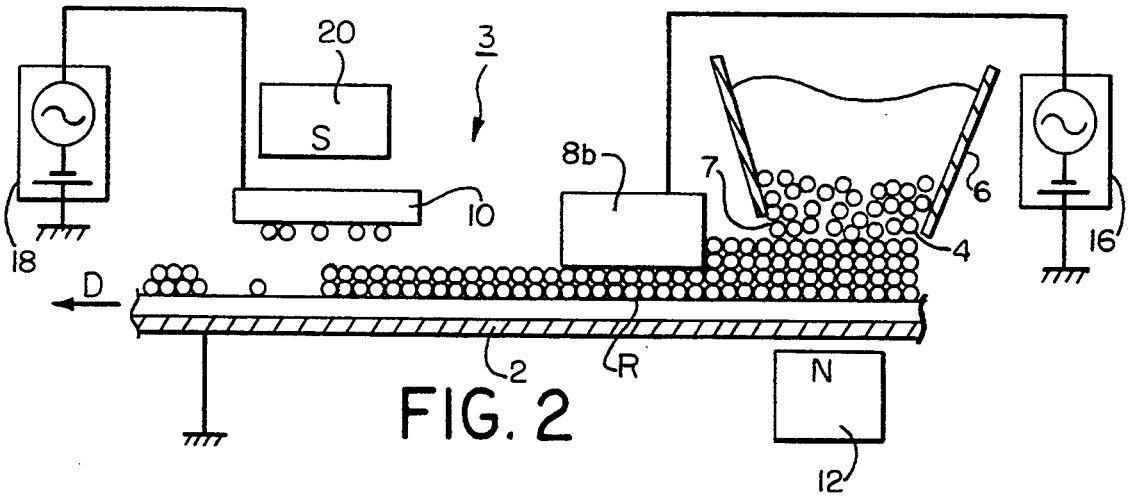
FIG. 2 is a view illustrating a basic structure for an image forming apparatus in another example according to the present invention.

FIG. 2 illustrates an image forming apparatus in a second example according to the present invention. Elements identical with those in the first example bear identical reference numerals, and description thereof will be omitted.

An image forming apparatus in the second example according to the present invention includes a charge applying member 8*b* instead of the charge applying member 8*a* in the structure in the first example. Further, the image forming apparatus includes a first magnetic field forming member 12 for forming a magnetic field in the vicinity of the developer container 6, a first power source 16 for applying a voltage to the charge applying member 8*b*, a second power source 18 for applying a voltage to the developer recovering member 10, and a second magnetic field forming member 20 for forming a magnetic field in the vicinity of the developer recovering member 10. The first magnetic field forming member 12 is located adjacent to the latent image carrier 2 so as to be opposed to the developer container 6. The first power source 16 applies an AC voltage obtained by superimposing DC voltages to the charge applying member 8*b*. The second power source 18 applies an AC voltage obtained by superimposing DC voltages to the developer recovering member 10. The second magnetic field forming member 20 is located adjacent to the developer recovering member 10 so as to be opposed to the latent image carrier 2. The developer 4 is insulative and magnetic.

The image forming apparatus is operated in the following manner.

The developer container 6 supplies the developer 4 to a surface of the latent image carrier 2, both to an image area and a non-image area, utilizing the magnetic attraction of a magnetic field formed by the first magnetic field forming member 12. As the latent image carrier 2 moves in a direction of arrow D in FIG. 2, the charge applying member 8*b* slides on the particles of the developer 4 carried on the surface of the latent image carrier 2, thereby charging the developer 4. Since an AC voltage obtained by superimposing DC voltages is applied to the charge applying member 8*b* by the first power source 16 at this point, a vibrating electric field is formed between the charge applying member 8*b* and an area of the latent image carrier 2 opposed to the charge applying member 8*b*. Since the developer 4 reciprocates between the latent image carrier 2 and the charge applying member 8*b* in accordance with the vibrating electric field, the developer 4 is charged as a result of friction caused by collision between the developer 4 and the charge applying member 8*b*, between the developer 4 and the latent image carrier 2, or among the particles of the developer 4.

The latent image carrier 2 then passes below the developer recovering member 10 while carrying the developer 4. Since an AC voltage obtained by superimposing DC voltages is applied to the developer recovering member 10 by the second power source 18, an alternating electric field is formed between the developer recovering member 10 and an area of the latent image carrier 2 opposed to the developer recovering member 10. Since the developer 4 reciprocates between the latent image carrier 2 and the developer recovering member 10 in accordance with the alternating electric field, the developer 4 is in a state of easily reacting to an external force. A magnetic field is formed between the developer recovering member 10 and the area of the latent image carrier 2 opposed to the developer recovering member 10 by the second magnetic field forming member 20. The developer 4 is in a state of easily reacting to an external force as is mentioned above. Accordingly, the particles of the developer 4 adhering to the non-image area and extra particles of the developer 4 adhering to the image area of the latent image carrier 2 are recovered by the developer recovering member 10, by an electric field created by the difference in potential between the surface of the latent image carrier 2 and the DC voltage component of the second power source 18 and a magnetic attraction of a magnetic field formed by the second magnetic field forming member 20. Thus, the latent image is developed.

In this example, the developer 4 is directly supplied to the whole surface of the latent image carrier 2, both on the image area and the non-image area thereof by the magnetic attraction of the magnetic field formed by the first magnetic field forming member 12. The developer 4 is then moved in the state of being attracted to the surface of the latent image carrier 2 by the magnetic attraction of the magnetic field formed by the first magnetic field forming member 12. By such a method, the developer 4 can reliably be provided in a necessary amount over the whole surface of the electrostatic latent image. Thus, the problem of defective development caused by the insufficient amount of the developer is solved.

In this example, an AC voltage obtained by superimposing DC voltages is applied to the charge applying member 8*b*, thereby creating a vibrating electric field between the charge applying member 8*b* and an area of the latent image carrier 2 opposed to the charge applying member 8*b*. The vibrating electric field is used to charge the developer 4. In such a system, the developer 4 can actively collide against the charge applying member 8*b* or can be attracted to the surface of the latent image carrier 2 by a DC voltage component of the vibrating electric field.

Since the developer 4 is vibrated when being charged, the particles of the developer 4 are uniformly distributed. The developer 4 which is charged is continuously in contact with the electrostatic latent image until the unnecessary portion thereof is recovered by the developer recovering member 10. For these two reasons, even an image including a very fine line can be reproduced quite accurately with no inconvenience such as blur or lack of the developer.

EXAMPLE 3

Figure 3:
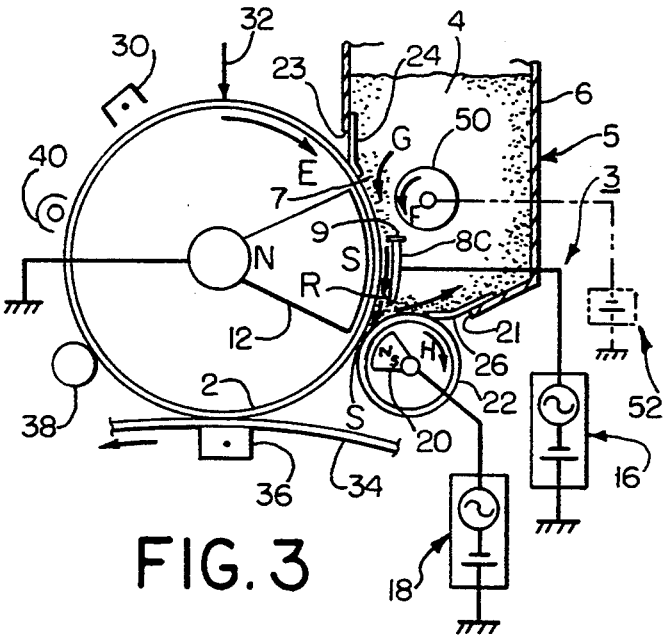
FIG. 3 is a cross sectional view of the image forming apparatus including the basic structure shown in FIG. 2.

FIG. 3 illustrates an image forming apparatus in a third example according to the present invention.

The image forming apparatus includes a latent image carrier 2 rotating in a direction of arrow E, a charger 30 for applying a specified charge to the latent image carrier 2, an optical system 32 for forming an electrostatic latent image on the latent image carrier 2, a developing device 3 for developing the electrostatic latent image to form a developer image, a transferring charger 36 for transferring the developer image on a sheet of recording paper (referred to as the "paper sheet", hereinafter) 34, a cleaning device 38 for removing a residual portion of the developer 4 from the latent image carrier 2, and an eraser 40 for removing any residual charge from the latent image carrier 2.

The developing device 3 mainly includes a developer supplying member 5 for directly supplying the developer 4 to a surface of the latent image carrier 2, a charge applying member 8*c* for charging the developer 4 supplied to the surface of the latent image carrier 2 using a vibrating electric field, and an electrode roller 22 for recovering the developer 4 adhering to a non-image area of the latent image carrier 2. The electrode roller 22 rotates in a direction of arrow H.

The image forming apparatus is operated in the following manner.

The surface of the latent image carrier 2 is uniformly charged by the charger 30 and then irradiated by light from the optical system 32, whereby an electrostatic latent image is formed on the latent image carrier 2.

The developer 4 is directly supplied to the surface of the latent image carrier 2 by the developer supplying member 5 and then charged by the charge applying member 8*c* on the latent image carrier 2. A portion of the developer 4 adhering to a non-image area is recovered by the electrode roller 22. Thus, the electrostatic latent image is developed to be a developer image.

The developer image on the latent image carrier 2 is transferred onto a paper sheet 34 which has been transported in synchronization with the developer image. The image transferred on the paper sheet 34 is fixed by a fixing device (not shown). Thus, image formation is completed. A residual portion of the developer 4 on the latent image carrier 2 is removed by the cleaning device 38, and residual charge on the latent image carrier 2 is removed by the eraser 40. Thus, the latent image carrier 2 is prepared for the next cycle of image formation.

A structure for the developing device 3 of the image forming apparatus in the third example will be described in detail.

First of all, the developing supplying member 5 of the developing device 3 will be described.

The developer supplying member 5 includes a developer container 6 having an opening 7. The opening 7 is proximate and opposed to the latent image carrier 2. The developer container 6 accommodates an insulative and magnetic developer 4 which is a monocomponent developer as a large unit. The developer 4 naturally flows out through the opening 7 by the weight thereof, and thus is supplied onto the surface of the latent image carrier 2 still as the large unit and spreads in the rotation direction thereof, both on an image area and a non-image area.

The developer container 6 includes a developer supplying roller 50 at an upstream position rotating in the direction of the latent image carrier 2, the developer supplying roller 50 being opposed to the latent image carrier 2. The developer supplying roller 50 rotates in a direction of arrow F oppositely to the rotation direction E of the latent image carrier 2. Due to such rotation directions of the latent image carrier 2 and the developer supplying roller 50, the developer 4 actively moves to the latent image carrier 2 from the developer container 6 as is indicated by arrow G. In this manner, supply of the developer 4 is promoted and stabilized at an upstream region of the opening 7.

The developer container 6 does not have to include the developer supplying roller 50. The developer supplying roller 50 or an appropriate transferring device substituting for the developer supplying roller 50 is preferably provided in the case where the weight of the developer 4 cannot be utilized or such a weight is hard to be utilized for supplying the developer 4, for example, in the case where the developer 4 is directly supplied from a position below the latent image carrier 2.

In the case where the developer supplying roller 50 is provided, the developer 4 is stirred to cause collision of particles of the developer 4 against one another, of the developer 4 and the developer supplying roller 50 against each other, and of the developer 4 and the latent image carrier 2 against each other, thereby charging the developer 4. When the particles of the developer 4 collide against one another, some of the particles are charged positively and the other particles are charged negatively. Although one of the polarities is opposite to the intended polarity, it is important that the particles are charged rather than which polarity the particles are charged. It is advantageous in the development process (described later) using a vibrating electric field that the developer 4 has a charge.

A voltage may be applied to the latent image carrier 2 connected to the ground by a third power source 52, thereby forming a DC electric field between the developer supplying roller 50 and the area of the latent image carrier 2 opposed to the developer supplying roller 50. In such a case, the developer 4 transported into such an electric field can actively move to the latent image carrier 2.

Thus, direct supply of the developer 4 is promoted by such an electric field in addition to the above-mentioned rotation directions of the latent image carrier 2 and the developer supplying roller 50.

The latent image carrier 2 includes a first magnetic field forming member 12, which is a fixed magnet. The first magnetic field forming member 12 is provided inside an area of the surface of the latent image carrier 2, the area receiving the developer 4 directly from the developer container 6. Namely, the area is substantially defined by an upstream end of the opening 7 of the developer container 6 and the electrode roller 22.

The first magnetic field forming member 12 magnetically attracts the magnetic developer 4. That is, the developer 4 which has been supplied to the surface of the latent image carrier 2 through the opening 7 is forcibly contacted and held on the above-mentioned area of the surface.

Thus, supply and transportation of the developer 4 through the whole area of the opening 7 is promoted as well as direct supply of the developer 4 at the upstream region of the opening 7.

An opening between an upstream perimeter 23 of the opening 7 and the latent image carrier 2 is covered with a seal 24. A lower end of the seal 24 is pressure-contacted on the surface of the latent image carrier 2 in a forward direction with respect to the rotation direction E of the latent image carrier 2. In such a structure, the developer 4 is prevented from flowing out through the opening between the upstream perimeter 23 of the developer container 6 and the latent image carrier 2.

By forming a connection section for connecting the upstream perimeter 23 and the latent image carrier 2 in an area influenced by the magnetic field of the first magnetic forming member 12, the leak of the developer 4 is more reliably prevented through the opening between the upstream perimeter 23 and the latent image carrier 2.

Next, the charge applying member **8*c* of the developing device 3** will be described, hereinafter.

The charge applying member **8*c* is a conductive plate opposed to the latent image carrier 2 between the developer supplying roller 50 and the electrode roller 22. A space R is defined by the charge applying member 8*c* and the latent image carrier 2, and the developer 4 adhering to the surface of the latent image carrier 2 is transported to the space R. The space R is substantially a rectangular parallelpiped and curved along the surface of the latent image carrier 2**.

In this example, the space R is set to have such a size that the density of the developer 4 transported thereto is reduced to 40% or less of an original density thereof. In this specification, the density is expressed by the ratio of the volume of the developer 4 in a space unit, which is referred to as the "spatial volumetric", hereinafter. The size of the space R, which is defined by the latent image carrier 2 and the charge applying member **8*c* will be referred to as the "width", hereinafter. The spatial volumetric ratio, which is determined based on the amount of the developer 4 transported by an area unit of the latent image carrier 2**, the width, the length and the like of the space R, is obtained by experiments.

The charge applying member **8*c* includes a restricting piece 9 at an upstream position thereof for restricting an amount of the developer 4 to adhere to the surface of the latent image carrier 2. The density of the developer 4 transported to the space R can easily be controlled by the restricting piece 9. The restricting piece 9** is formed of a metal plate, a rubber sheet, a polyethyleneterephthalate sheet, a fiber brush or the like.

An AC voltage with DC voltages superimposed is applied to the charge applying member **8*c* by a first power source 16, thereby forming a vibrating electric field between the charge applying member 8*c* and an area of the latent image carrier 2 opposed to the charge applying member 8*c***.

A portion of the developer 4 transported to the space R is naturally charged and another portion thereof is charged by the developer supplying roller 50. The developer 4 reacts to the vibrating electric field and thus reciprocates between the latent image carrier 2 and the charge applying member **8*c*. While reciprocating, the developer 4 is charged by collision of particles of the developer 4 against one another, collision of the developer 4 and the charge applying member 8*c* against each other, and collision of the developer 4 and the latent image carrier 2 against each other. A portion of the developer 4 charged in this manner influences an uncharged portion of the developer 4. As a result, the whole part of the developer 4** transported between the latent image carrier 2 and the charge applying member 8c can be charged with a specified polarity and a specified charge without compression or any other extreme stress.

The latent image carrier 2 and the charge applying member 8c constitute a charging device for charging the developer 4. The latent image carrier 2 further acts as a transporting member for forcibly transporting the developer 4 thereon to the charging device to be used for development. In such a structure, a special device is not necessary for transporting the developer 4. Still further, by the magnetic attraction of the first magnetic field forming member 12 provided in the latent image carrier 2, the developer 4 is held to the vibrating electric field without being scattered. Thus, the charging efficiency of the developer 4 is improved.

A surface of the charge applying member 8c opposed to the latent image carrier 2 is preferably formed of a material which is highly conductive and easily charged with an opposite polarity to that of the developer 4 so that the developer 4 easily collides against the charge applying member 8c due to the vibrating electric field. The surface of the charge applying member 8c is preferably hard to be worn by collision against the developer 4, and further smoother than the surface of the particles of the developer 4 so as to have a sufficient area to be in contact with the developer 4. Practically, the surface of the charge applying member 8c is formed of, for example, stainless steel, a metal such as brass, a conductive resin such as fluorocarbon polymers or polyamide, or a metal plating such as gold plating or chrome plating.

Since the developer 4 is forcibly transported by magnetic attraction of the first magnetic field forming member 12 and the rotation of the latent image carrier 2, a decline in the fluidity of the developer 4 caused by rise in humidity does not influence the transportation of the developer 4. Accordingly, the developer 4 can stably be transported in an appropriate amount through the space R where the electric field is formed.

Since the first magnetic field forming member 12 is provided inside the latent image carrier 2, the image forming apparatus is not enlarged in size, and the structure thereof is not complicated.

Even without the first magnetic field forming member 12, only the rotation of the latent image carrier 2 is sufficient for properly transporting the developer 4 through the space R. Especially in this example, since the developer 4 flows in the transportation direction thereof by the weight thereof, the developer 4 can sufficiently be transported by the rotation of the latent image carrier 2.

In the case where a vibrating electric field is formed between the charge applying member 8c and the latent image carrier 2, and the developer 4 is forcibly transported through the vibrating electric field, the developer 4 is charged in the vibrating electric field in a steady state. Accordingly, the developer 4 can be charged as specified without insufficient or non-uniform charging and provided in a certain amount to be used for development. As a result, development of an electrostatic latent image using the charge of the developer 4 can be performed in a stable state.

After being charged, the developer 4 adheres to both an image area and a non-image area of the surface of the latent image carrier 2 with at least an adhering force generated by intermolecular force, image force caused by charges, and the like as well as with the magnetic attraction of the first magnetic field forming member 12. The developer 4 adheres to the latent image carrier 2 with an influence of the state of the electrostatic latent image and the polarity of the developer 4, thereby forming an image. At this point, the image area and the non-image area are not distinguished from each other, and thus the resultant image is far from a developer image to be formed after the developing process is finished.

As is mentioned above, a DC voltage component is applied to the charge applying member 8c by the first power source 16. The developer 4 collides against the latent image carrier 2 or against the charge applying member 8c, depending on the level of the DC voltage component applied to the charge applying member 8c.

The charge applying member 8c can charge the developer 4 much more strongly than the latent image carrier 2 does. Accordingly, in the case where the DC voltage is applied at such a level as to cause the developer 4 to collide against the charge applying member 8c, the charging efficiency is higher. It is important the DC voltage should be applied at an appropriate level so that the charging level of the electrostatic latent image is not changed as is by the amplitude of the AC voltage.

The developer 4 may be controlled to collide against the latent image carrier 2. In such a case, the developer 4 is attracted to both an image area and a non-image area, thereby improving the adherence of the developer 4 on the latent image carrier 2. The developer 4 hardly adheres to the surface of the charge applying member 8c, and thus the charging efficiency of the developer 4 is stable.

Alternatively, the developer 4 may be controlled to collide against the charge applying member 8c in the space R so as to be sufficiently charged and then to collide against the latent image carrier 2 by the magnetic attraction of the first magnetic field forming member 12 after passing the space R so as to properly adhere to the latent image carrier 2.

In this case also, whether DC voltages should be superimposed, and if so, what level of the DC voltages should be used are determined in consideration of the influence of the DC voltage on charging of the developer 4.

How accurately an image can be formed according to the present invention will be described with an image having a fine line as an example.

Figure 9A:
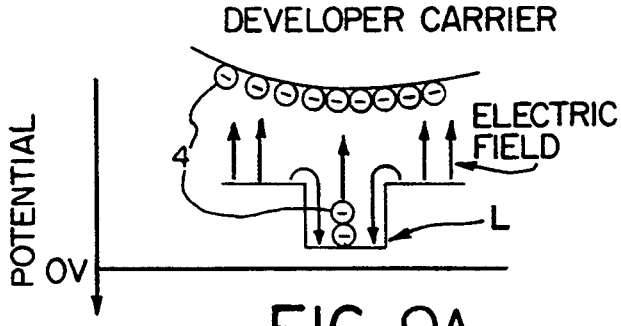
FIG. 9A shows a developer in the vicinity of a fine line portion on a surface of a latent image carrier in a conventional image forming apparatus.

In a conventional image forming apparatus, as is shown in FIG. 9A, an electric field is formed between the latent image carrier and a peripheral portion of a fine line portion L. Accordingly, the developer 4 does not properly adhere to the fine line portion L. The resultant image has a line which is thinner than the fine line of the original image.

Figure 9B:
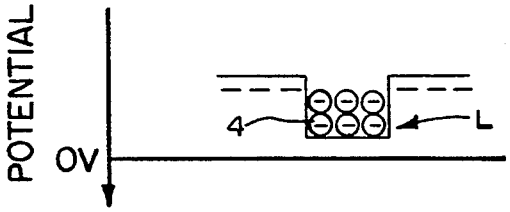
FIGS. 9B and 9C show a developer in the vicinity of a fine line portion on a surface of a latent image carrier in the present invention.
Figure 9C:
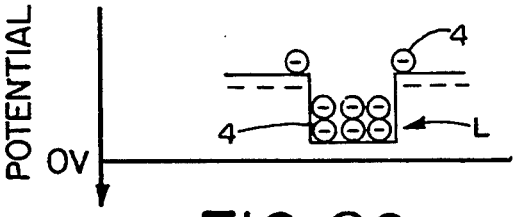

By contrast, according to the present invention, as is shown in FIG. 9B, the developer 4 is directly supplied to both an image area and a non-image area on the surface of the latent image carrier 2. Accordingly, the developer 4 adheres to the surface with no influence from an electric field. If the developer 4 is not sufficiently charged, as is shown in FIG. 9C, an unnecessary portion of the developer 4 is not sufficiently recovered, thereby forming a line which is wider than the fine line of the original image. It is important that the developer 4 is sufficiently charged.

Finally, the electrode roller 22 of the developing device 3 will be described.

The electrode roller 22, which is provided for recovering the developer 4, rotates in an identical direction with the latent image carrier 2 as indicated by arrow H. The electrode roller 22 is formed of a conductive material, and provided between a downstream perimeter 21 of the opening 7 and the latent image carrier 2 so as to be opposed to the latent image carrier 2. A space S is formed between the electrostatic latent image on the latent image carrier 2 and the electrode roller 22. A portion of the space S has a specified width. The developer 4 is recovered in the space S.

An AC voltage with DC voltages superimposed is applied to the electrode roller 22 by a second power source 18, thereby forming an alternating electric field in the space S which has a force for recovering a portion of the developer 4 adhering to the non-image area.

The alternating electric field supplies the developer 4 adhering to both an image area and a non-image area with an oscillating force with which the developer 4 reciprocates between the electrode roller 22 and the area of the latent image carrier 2 opposed to the electrode roller 22. In this manner, the developer 4 in the space S is kept in a cloud state, namely, a state of being atomized.

Since the developer 4 is charged at a specified level in this example, the portion of the developer 4 adhering to the non-image area sufficiently reacts to the alternating electric field. Thus, the developer 4 overcomes the force of the electric field generated by the DC voltage component of the AC voltage applied by the second power source 18, the magnetic attraction of the first magnetic field forming member 12, and the adhering force of the developer 4 caused by intermolecular force and image force. As a result, the developer 4 is forcibly separated from the non-image area of the surface of the latent image carrier 2 to move toward the electrode roller 22. Thus, the developer 4 adheres to a surface of the electrode roller 22 rotating in the direction of arrow H. In this manner, the developer 4 is recovered.

The electrode roller 22 includes a second magnetic field forming member 20, which is a fixed magnet. Magnetic attraction of the second magnetic field forming member 20 contributes to the separation of the developer 4 from the non-image area.

Since separation of the developer 4 from the latent image carrier 2 is repeated utilizing energy generated by the collision between the developer 4 and the latent image carrier 2 caused by the vibrating electric field, the developer 4 can reliably be recovered.

In the same manner, an extra amount of the developer 4 adhering to the image area of the latent image carrier 2 is forcibly separated therefrom. As described above, the developer 4 moves toward the electrode roller 22 and then recovered in the state of adhering to the surface of the electrode roller 22 rotating in the direction of arrow H.

In the manner which has been described so far, even an image including a fine line can be reproduced accurately and precisely in accordance with the electrostatic latent image on the latent image carrier 2. As a result, a high quality image can be formed.

The electrode roller 22 is pressed by a scraper 26 extended from the downstream perimeter 21 of the developer container 6. The scraper 26 is pressed in a reverse direction with respect to the rotation direction H of the electrode roller 22, and thus an opening between the developer container 6 and the electrode roller 22 is sealed. In such a structure, the developer 4 is prevented from flowing out through the opening. The developer 4 recovered by the electrode roller 22 is scraped by the scraper 26 and returned to the developer container 6.

The scraper 26 is a plate formed of an alloy of phosphorus and bronze, a metal such as stainless steel, a resin such as polyethyleneterephthalate, or rubber.

The space S is sealed by magnetically holding the developer 4 on the latent image carrier 2 or the electrode roller 22 using the magnetic field formed between the first magnetic field forming member 12 and the second magnetic field forming member 20 in the electrode roller 22. Accordingly, only a portion of the developer 4 adhering to the image area of the latent image carrier 2 is transported through the space S. Even if the developer 4 flows out to a downstream position between the latent image carrier 2 and the electrode roller 22, such a developer 4 is attracted to the electrode roller 22 by the second magnetic field forming member 20. The second magnetic field forming member 20 should be provided at a downstream position in order to attract the developer 4 in such a case. Then, the developer 4 is recovered in a state of adhering to the surface of the electrode roller 22.

In this manner, the developer 4 is prevented from leaking between the developer container 6 and the latent image carrier 2, between the electrode roller 22 and the developer container 6, and between the latent image carrier 2 and the electrode roller 22. Further, since the charge applying member 8c is provided in the developer container 6, even leaks of the developer 4 from the vibrating electric field does not cause the developer 4 to flow outside the area influenced by the charge applying member 8c. Accordingly, devices and members outside the developer container 6 such as the charger 30 and the optical system 32 are not stained by the developer 4.

As described above, the developer container 6 has a sealed space so that the developer 4 therein would not leak outside. Only the developer 4 adhering to the image area on the surface of the latent image carrier 2 can come out of the sealed space. The developer 4 adhering to the non-image area on the surface of the latent image carrier 2 does not come out of the developer container 6, unlike the conventional image forming apparatus. Therefore, it is possible to prevent the outside of the developer container 6 from being stained by the developer 4.

Figure 4:
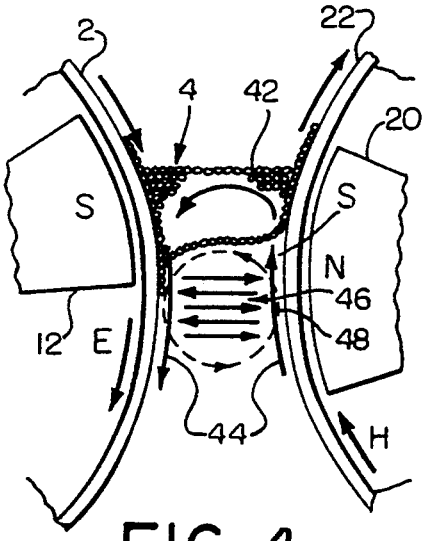
FIG. 4 is a partial enlarged view illustrating an operation of the image forming apparatus shown in FIG. 3.

The image forming apparatus in the third example according to the present invention will be described with reference to FIGS. 3, 4 and 5.

Figure 5:
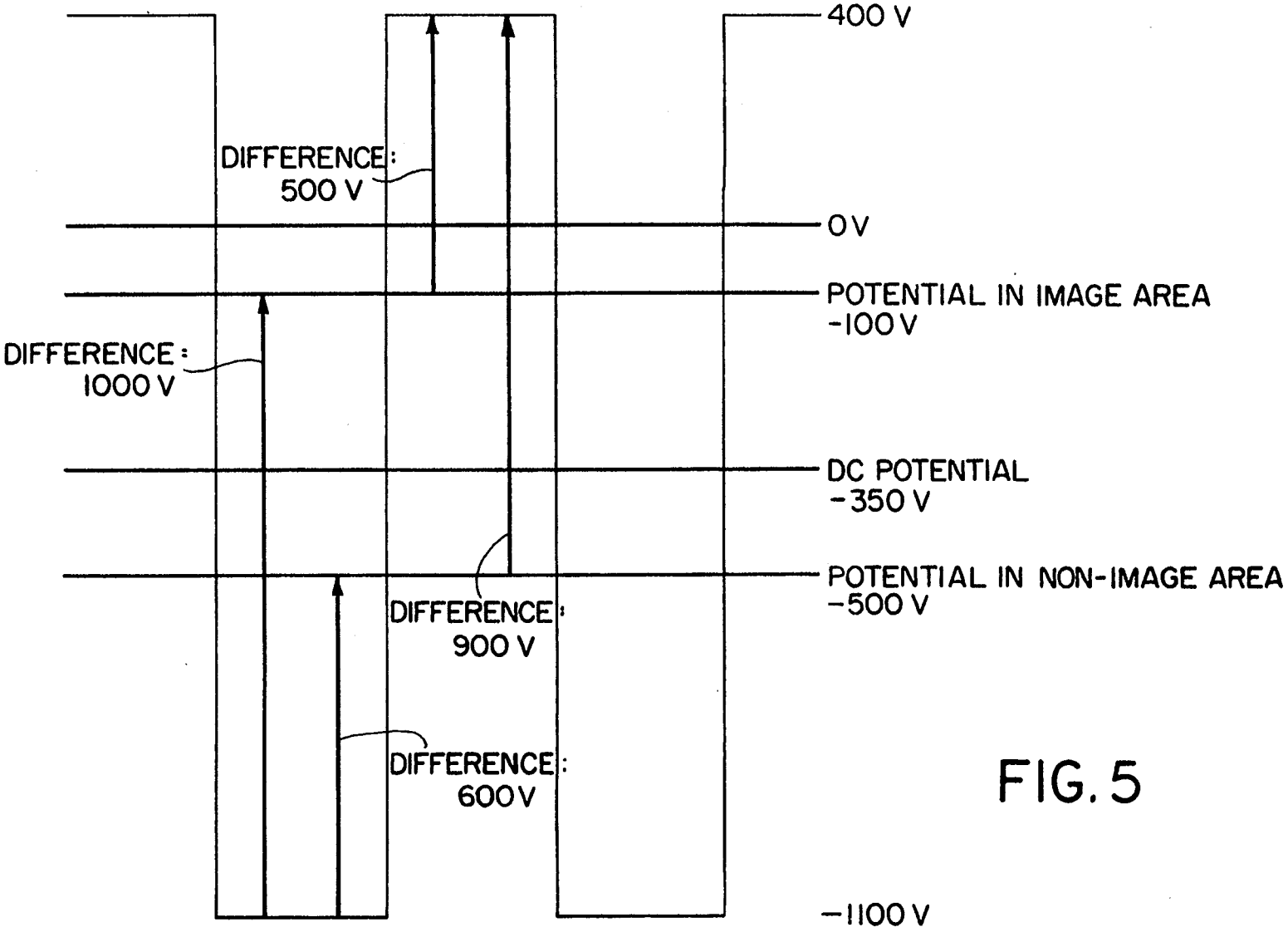
FIG. 5 is a view showing an example of the electrical operation of the image forming apparatus shown in FIG. 3.

The surface of the latent image carrier 2 is uniformly charged by the charger 30, and an electrostatic latent image is formed on the surface so that the electrostatic latent image has a voltage of $-100$ V on the image area and a voltage of $-500$ V at the non-image area as is shown in FIG. 5.

The developer 4 supplied to the latent image carrier 2 is charged at a level of about $-8$ $\mu$C/g by the charge applying member 8c using the vibrating electric field.

If the charging level of the developer 4 is too low, the developer 4 is not supplied with a sufficient oscillating force by the electric field with respect to the adhering force between the developer 4 and the latent image carrier 2 or between the developer 4 and the charge applying member 8c. As a result, the developer 4 cannot oscillate. If the charging level is too high, the adhering force generated by the image force caused by the charge is too strong, thereby preventing the oscillation of the developer 4.

The effective charging level for the developer 4 in this example is in the range of $-0.5\ \mu C/g$ to $-40\ \mu C/g$. In consideration of the oscillation of the developer 4, the effective charging level is preferably in the range of $-3\ \mu C/g$ to $-15\ \mu C/g$.

Since the space R is set to have such a width that the spatial volumetric ratio of the developer 4 transported thereto is reduced to 40% or less of an original spatial volumetric ratio thereof, the developer 4 starts oscillating and a portion of the developer 4 in the vibrating electric field influences another portion of the developer 4 reliably and at a high speed. During the above oscillation, the developer 4 can move sufficiently freely.

According to experiments conducted by a team of researchers including the inventors of the present invention, the developer 4 reaches a most dense state with the spatial volumetric ratio of approximately 60%, and cannot oscillate even by the vibrating electric field. In such a case, the developer 4 is hardly charged. In the case where the spatial volumetric ratio is 40% or less by contrast, the developer 4 can be oscillated by the vibrating electric field and thus sufficiently charged.

The width of the space R, together with the spatial volumetric ratio, defines the amount of the developer 4 to be supplied to be exposed to a phenomenon using the charge. In this example, the developer 4 can sufficiently be charged when the width of the space R is 40 μm to 2 mm. Even if the width is as small as less than 40 μm, sufficient charging is performed as long as the width is sufficiently large for the developer 4 to pass therethrough. If the width is too small, the developer 4 cannot oscillate actively and thus cannot sufficiently be charged. In such a case, the charge applying member 8c and the latent image carrier 2 possibly contact each other, thereby damaging the surface of the latent image carrier 2 or spoiling the electrostatic latent image. For these reasons, the width of the space R is preferably 40 μm or more.

An AC voltage of a rectangular wave having a peak-to-peak voltage of 1000 V with DC voltages superimposed is applied to the charge applying member 8c by the first power source 16. By such voltage application, the vibrating electric field is formed in the space R between the latent image carrier 2 and the charge applying member 8c, whereby the developer 4 reciprocates in the space R. The AC voltage may have a sinusoidal wave, or a triangular wave instead of a rectangular wave. With a rectangular wave, an effective electric field intensity can be set to be as high as possible with no discharge being occurred by dielectric breakdown. Accordingly, a rectangular wave is preferable. In the case where the width of the space R is set to be approximately 70 μm, a peak-to-peak voltage in the range of 500 V to 1000 V can be used, where good charging characteristics can be realized with no discharge. A frequency in the range of 100 Hz to 10 kHz can be used, and a frequency in the range of 500 Hz to 3 kHz is preferable. At a frequency of less than 500 Hz, the developer 4 can not oscillate by the required number, and at a frequency of more than 3 kHz, the developer 4 can not reciprocate in accordance with the vibration of the electric field.

The time period during which the developer 4 should be exposed to the charging process is directly determined by the length of the space R and the speed by which the developer 4 adhering on the latent image carrier 2 passes through the space R. In this example, sufficient charging is obtained when the length of the space R is 0.5 to 10 mm and the speed of the developer 4 on the latent image carrier 2 is 500 mm/sec. At such a speed, 70 images of the A4 size can be formed per minute.

As is mentioned above, the developer 4 is magnetic. Accordingly, as is shown in FIG. 4, the developer 4 is attracted and held in the space S in a chain 42 in accordance with the state of a magnetic flux formed between the latent image carrier 2 and the electrode roller 22 by the first and the second magnetic field forming members 12 and 20. Since the latent image carrier 2 and the electrode roller 22 rotate in opposite directions from each other, a portion of the developer 4 proximate to the latent image carrier 2 is transported in the same direction therewith as a flow 44, and another portion proximate to the electrode roller 22 is transported in the same direction therewith as another flow 44. An amount of the developer 4 in the chain 42 is determined based on the magnetic flux density, magnetic characteristics of the developer 4 and the like and kept in that amount. Even if a part of the chain 42 of the developer 4 is removed in the state of a flow 44, substantially the same amount of the developer 4 is supplemented. As a result, the developer 4 is constantly kept in an almost identical amount as the chain 42. Due to such a system, the developer 4 can be supplied substantially in an identical amount for development.

An AC voltage of a rectangular wave having a peak-to-peak voltage of 1500 V as shown in FIG. 5 is applied to the electrode roller 22, whereby the developer 4 reciprocates in the space S. A rectangular wave is preferable for the same reasons as mentioned for the charge applying member 8c. In the case where the width of the space S is set to be approximately 350 μm as in this example, a peak-to-peak voltage in the range of 500 V to 2000 V can be used, where a satisfactory image can be formed with no discharge. Needless to say, if the width of the space S is changed, the peak-to-peak voltage should be changed. A frequency in the range of 100 Hz to 10 kHz can be used, and a frequency in the range of 500 Hz to 3 kHz is preferable. At a frequency of less than 500 Hz, the developer 4 can not oscillate by a required number, and at a frequency of more than 3 kHz, the developer 4 can not reciprocate in accordance with the vibration of the electric field.

The flows 44 and a reciprocating flow 46 of the developer 4 cooperate with each other to form a circulating flow 48. The developer 4 circulates in this manner in an area of the space S. Since the alternating electric field causes the developer 4 to reciprocate in accordance with the alternating electric field in the space S, the developer 4 reciprocates repeatedly. As a result, even when an uncharged portion of the developer 4 exists in the space S, the uncharged portion also reciprocates repeatedly by an influence of the charged portion of the developer 4. The uncharged portion is sufficiently charged by collision of particles of the developer 4 against one another and collision of the developer 4 and the electrode roller 22 against each other. In such a case, the electrode roller 22 applies a charge to the developer 4 as the charge applying member 8c does.

By the repetition of the reciprocation, particles of the developer 4 are scattered and move actively. Even if a part of the particles of the developer 4 has a very low charging level due to insufficient charging and adheres to the non-image area of the latent image carrier 2 by intermolecular force or the like in the condition of being hard to be electrically recovered, other particles of the developer 4 which actively move beat away and thus separate the particles from the latent image carrier 2. As a result, an image with no blur is obtained.

The developer 4 reciprocates in the following manner in the space S. When the negative peak of the peak-to-peak voltage is −1100 V on the image area, the developer 4 oscillates in a direction in which the developer 4 is supplied. Such oscillation is caused by an oscillating force generated by an electric field formed by a difference between the charging level of the image area and the above-mentioned negative peak, the difference being 1000 V. When the positive peak thereof is 400 V, the developer 4 oscillates in a direction in which the developer 4 is recovered. Such oscillation is caused by an oscillating force generated by an electric field formed by a difference between the charging level of the image area and the above-mentioned positive peak, the difference being 500 V. By one reciprocation, the developer 4 adheres to the image area by a difference between the above-mentioned two differences in potential. Thus, image formation progresses. In a similar manner, when the negative peak of the peak-to-peak voltage is −1100 V on the non-image area, the developer 4 oscillates in a direction in which the developer 4 is supplied. Such oscillation is caused by an oscillating force generated by an electric field formed by a difference between the charging level of the image area and the above-mentioned negative peak, the difference being 600 V. When the positive peak thereof is 400 V, the developer 4 oscillates in a direction in which the developer 4 is recovered. Such oscillation is caused by an oscillating force generated by an electric field formed by a difference between the charging level of the image area and the above-mentioned positive peak, the difference being 900 V. By one reciprocation, the developer 4 is recovered from the non-image area by a difference between the above-mentioned two differences in potential.

As the space S between the electrostatic latent image on the latent image carrier 2 and the electrode roller 22 is gradually enlarged by the rotation of the latent image carrier 2, the electric field intensity is gradually reduced, and accordingly, the reciprocation of the developer 4 gets gradually inactive. Thus, development is completed.

As is mentioned above, even if a part of the developer 4 is insufficiently charged as mentioned above, the collision between the developer 4 and the latent image carrier 2 or the electrode roller 22 in the space S and the collision of the particles of the developer 4 against one another cooperate with each other to progress the charging, until such a part of the developer 4 is finally sufficiently charged. Thus, image formation is performed with no problem.

By the development process of supply, charging and recovery of the developer 4, an extra portion of the developer 4 adhering to the image area is recovered by the electrode roller 22 so as to leave the developer 4 on the latent image carrier 2 in an optimum amount for development. Since a portion of the developer 4 adhering to the non-image area is actively recovered by the electrode roller 22, the developer 4 is left only on the image area. Thus, even an image including a fine line can be reproduced accurately in accordance with the electrostatic latent image with no blur.

The space S between the electrostatic latent image on the latent image carrier 2 and the electrode 22 is enlarged by the rotation of the latent image carrier 2 as mentioned above. Since a magnetic flux exists between the latent image carrier 2 and the electrode roller 22, a part of the developer 4 floating in the space S is easily recovered by the electrode roller 22 and passes through as the chain 42. As a result, the developer 4 is prevented from flowing out. After being recovered, the developer 4 is scratched off from the electrode roller 22 by the scraper 26 and returned to the developer container 6. Accordingly, loss of the developer 4 is minimized.

A part of the developer 4 which is recovered by the electrode roller 22 to be a flow 44 and then returned to the chain 42 is again combined with the flow 44 to be a circulating flow 48.

The space S can be set to have any width. In consideration of the characteristics of the developer image, the width of the space S is preferably in the range of 100 μm to 2 mm, and more preferably in the range of 200 μm to 500 μm. In the latter range, a highly excellent developer image can be formed.

The space S can be set to be wider than the space R between the latent image carrier 2 and the charge applying member 8*c*. The space R is preferably as narrow as possible for the following reason: many uncharged particles of the developer 4 exist in the space R, and such particles are hard to oscillate in accordance with the vibrating electric field formed in the space R. As the space R is narrower, the ratio of the particles of the developer 4 colliding against the charge applying member 8*c* is higher. In the space S by contrast, most particles of the developer 4 have sufficiently been charged. Accordingly, the developer 4 can oscillate in accordance with the vibrating electric field even if the space S is not narrow. To the contrary, the space S is preferably wide to some extent, so that particles of the developer 4 floating in the space S can be prevented from colliding against one another, and thus the movement of the developer 4 can be more active.

EXAMPLE 4

Figure 6:
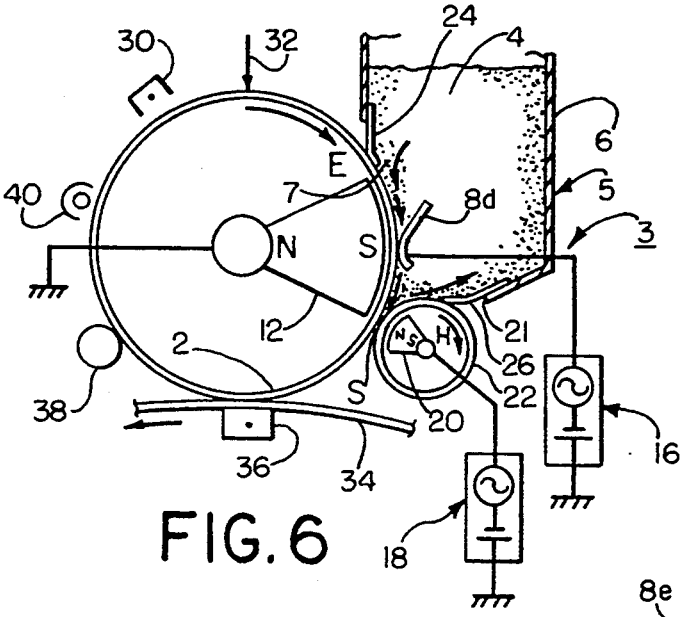
FIG. 6 is a cross sectional view of an image forming apparatus in still another example according to the present invention.

An image forming apparatus in a fourth example according to the present invention will be described with reference to FIG. 6. Identical members with those in Example 3 bear identical reference numerals, and description thereof will be omitted.

The image forming apparatus in the third example includes a charge applying member 8*d* having a different structure from the charge applying member 8*c*. The charge applying member 8*d* is a plate used as a spring having a thickness of 0.5 mm and is formed of a conductive alloy of phosphorus and brass. The charge applying member 8*d* can be pressure-contacted on the latent image carrier 2. Usually, the charge applying member 8*d* is pressed up by a force the developer 4 adhering to the surface of the latent image carrier 2 so as to be out of contact from the latent image carrier 2. As is disclosed in Japanese Patent Publication No. 63-16736, the charge applying member 8*d* restricts the amount of the developer 4 supplied to the surface of the latent image carrier 2 to a certain amount determined based on the elasticity of the charge applying member 8*d*, the amount of the developer 4 carried on an area unit of the latent image carrier 2 and the like. The developer 4 between the charge applying member 8*d* and an area of the latent image carrier 2 opposed to the charge applying member 8*d* is exposed to stress as well as a force generated by the electric field formed by the first power source 16. Accordingly, the developer 4 is charged by friction caused by compression in addition to that caused by collision. In such a structure, the charging efficiency is high.

Importantly, in the case when a portion where the latent image carrier 2 and the charge applying member 8*d* are opposed to each other is extended in a downstream direction from a position where the latent image carrier 2 and the charge applying member 8*d* are closest to each other, the developer 4 which has already been charged to some extent by collision and friction reciprocates and thus is further charged in the extended portion. As a result, the charging efficiency of the developer 4 is remarkably improved.

An image forming apparatus according to the present invention can be modified in various ways. For example, although the developer 4 is charged by the vibrating electric field formed between the latent image carrier 2 and the charge applying members 8*c* and 8*d* in this example, the charge may be directly applied using a corona charger or the like. In this case, it is difficult to charge only the developer 4 without influencing the electrostatic latent image on the latent image carrier 2, and thus such a method is not preferable.

A portion of the developer 4 adhering to the non-image area of the latent image carrier 2 is recovered by an AC voltage obtained by superimposing DC voltages by the second power source 18 in this example. Instead, the developer 4 may be recovered by another power source applying only a DC voltage or only by the magnetic field formed by the second magnetic field forming member 20. Moreover, in the case where the first power source 16 and the second power source 18 are formed by an identical power source, the size of the image forming apparatus of the present invention is further reduced.

In the above examples, the electrode roller 22 rotates in the same direction as the latent image carrier 2, but may rotate in the opposite direction thereto. In the latter case, the developer 4 does not move as a flow 44, a reciprocating flow 46 or a circulating flow 48, but appropriate development can be realized by adjusting the supply amount of the developer 4, and the rotating speed of the latent image carrier 2 and the electrode roller 22.

The developer 4 may be carried by the surface of the electrode roller 22 and supplied to the surface of the latent image carrier 2. In this case, the following conditions are necessary in order to directly supply the developer 4 to the surface of the latent image carrier 2: The surface of the electrode roller 22 can carry the developer 4 in a larger amount than is necessary for development; a developer reservoir is formed from which the developer 4 is supplied between the space S between the electrostatic latent image and the electrode roller 22 to an upstream side in the rotation direction of the latent image carrier 2; and the developer 2 is charged on the latent image carrier 2 by the vibrating electric field formed by the charge applying members 8*c* and 8*d* before the developer 4 reaches the space S.

The space between the latent image carrier 2 and the charging member is not necessary substantially parallel, but can be changed as necessary.

Figure 7:
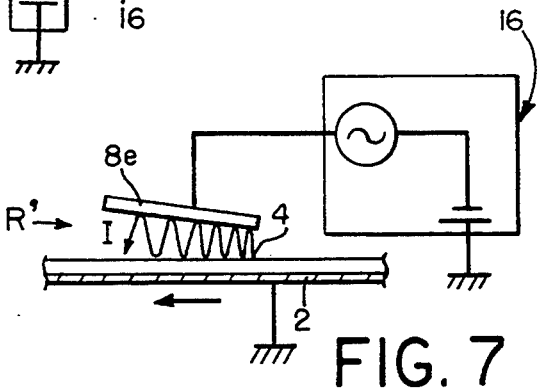
FIG. 7 is a cross sectional view of an image forming apparatus in still another example according to the present invention.
Figure 8:
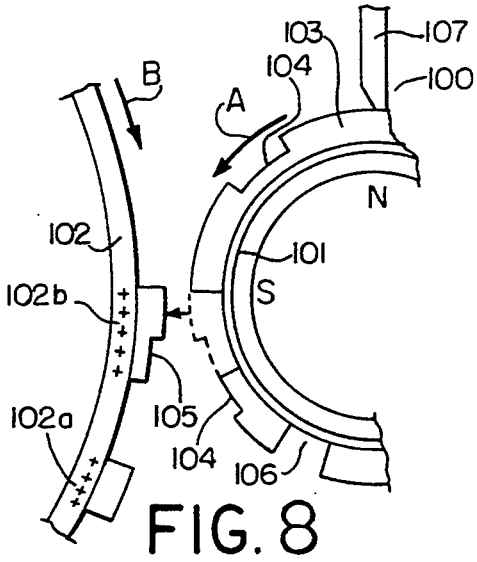
FIG. 8 is a view of a conventional image forming apparatus, illustrating a principle by which sleeve ghost is generated.

For example, in an image forming apparatus illustrated in FIG. 7, a space R′ between the latent image carrier 2 and a charge applying member 8*e* is tapered with an exit for the developer 4 being larger than an entrance.

In such a structure, the developer 4 oscillates as is indicated by arrow I. Each time the developer 4 collides against the latent image carrier 2 or the charge applying member 8*e*, the developer 4 receives a component of force of movement or diffusion, thereby moving toward the exit. Accordingly, the developer 4 supplied between the latent image carrier 2 and the charge applying member 8*e* can forcibly be transported without any special member or moving such a member. As a result, a special developer supplying member is not required, thereby realizing a simple structure and a low production cost.

Instead of the tapered space R′, any type of space may be adopted as long as the developer 4 can be transported in a specified direction in accordance with the vibrating electric field.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image forming apparatus, comprising:

latent image carrying means moving while carrying an electrostatic latent image on a surface thereof;

developer supplying means for supplying a developer to a whole electrostatic latent image on the surface of the latent image carrying means including an image area and a non-image area;

charging means for charging the developer on the surface of the latent image carrying means; and developer recovering means for recovering a portion of the developer adhering to the non-image area of the surface of the latent image carrying means.

2. An image forming apparatus according to claim 1, wherein the charging means includes charge applying means and means for forming a vibrating electric field between the charge applying means and the latent image carrying means; and the developer supplied to the electrostatic latent image on the surface of the latent image carrying means is oscillated by the vibrating electric field between the latent image carrying means and the charge applying means.

3. A charging device according to claim 1, wherein the developer is supplied to the whole electrostatic latent image on the surface of the latent image carrying means by using gravity.

4. An image forming apparatus, comprising:

latent image carrying means moving while carrying an electrostatic latent image on a surface thereof;

developer supplying means for supplying a developer to a whole electrostatic latent image on the surface of the latent image carrying means including an image area and a non-image area;

charging means for charging the developer on the surface of the latent image carrying means, wherein the charging means includes charge applying means and means for forming a vibrating electric field between the charge applying means and the latent image carrying means, wherein the charge applying means is provided to be opposed to and to be in contact with the latent image carrying means and has mechanical elasticity so as to be put out of contact from the latent image carrying means when being pressed up by the developer supplied to the surface of the latent image carrying means, and the developer supplied to the electrostatic latent image on the surface of the latent image carrying means is oscillated by the vibrating electric field between the latent image carrying means and the charge applying means; and developer recovering means for recovering a portion of the developer adhering to the non-image area of the surface of the latent image carrying means.

5. An image forming apparatus, comprising:

latent image carrying means moving while carrying an electrostatic latent image on a surface thereof;

developer supplying means for supplying a developer to a whole electrostatic latent image on the surface of the latent image carrying means including an image area and a non-image area;

charging means for charging the developer on the surface of the latent image carrying means, wherein the charging means includes charge applying means and means for forming a vibrating electric field between the charge applying means and the latent image carrying means, and the developer supplied to the electrostatic latent image on the surface of the latent image carrying means is oscillated by the vibrating electric field between the latent image carrying means and the charge applying means; and developer recovering means for recovering a portion of the developer adhering to the non-image area of the surface of the latent image carrying means, including roller means opposed to the latent image carrying means and means for forming an alternating electric field between the roller means and the latent image carrying means, and the developer charged on the surface of the latent image carrying means is reciprocated between the latent image carrying means and the roller means by the alternating electric field, whereby the portion of the developer adhering to the non-image area of the electrostatic latent image is recovered to the roller means;

wherein the vibrating electric field between the charge applying means and the latent image carrying means and the alternating electric field between the roller means and the latent image carrying means are formed by an identical power source.

6. A charging device, comprising:

latent image carrying means moving while carrying an electrostatic latent image on an area of a surface thereof;

charging means opposed to the latent image carrying means;

a power source for forming an AC electric field for charging substantially all the developer between the charging means and the latent image carrying means; and developer supplying means for supplying a developer between the charging means and the latent image carrying means.

7. A charging device according to claim 6, wherein:

the developer includes a magnetic developer; and the developer supplying means includes a magnet proximate an area of the surface of the latent image carrying means, the area being opposite to the area of the surface holding the electrostatic latent image, and the developer is held on the surface of the latent image carrying means and supplied between the latent image carrying and the charging means by movement of the latent image carrying means and made to pass therebetween.

8. A charging device according to claim 6, wherein:

the developer includes a magnetic developer; and the developer supplying means includes a magnet on an area opposite to the area of the surface holding the electrostatic latent image, the developer is held on the surface of the latent image carrying means by a magnetic field of the magnet and supplied between the latent image carrying means and the charging means by movement of the latent image carrying means and made to pass therebetween, and the developer supplied to the electrostatic latent image on the surface of the latent image carrying means in the magnetic field is oscillated by the alternating electric field between the latent image carrying means and the charge means.

9. An image forming apparatus, comprising:

latent image carrying means moving while carrying an electrostatic latent image on a surface thereof;

developer supplying means for supplying a developer to a whole electrostatic latent image on the surface of the latent image carrying means including an image area and a non-image area, the developer including a magnetic developer, the developer supplying means including means for forming a magnetic field on and in the vicinity of the electrostatic latent image, and the developer is supplied to the whole electrostatic latent image by using the magnetic field;

charging means for charging the developer on the surface of the latent image carrying means; and developer recovering means including roller means opposed to the latent image carrying means and means for forming an alternating electric field between the roller means and the latent image carrying means, and the developer charged on the surface of the latent image carrying means is reciprocated between the latent image carrying means and the roller means by the alternating electric field, whereby a portion of the developer adhering to the non-image area of the electrostatic latent image is recovered to the roller means.

10. An image forming apparatus according to claim 9, wherein the roller means is rotated similarly to the latent image carrying means.

11. An image forming apparatus according to claim 9, wherein the minimum distance between the developer recovering means and the latent image carrying means is larger than the minimum distance between the charging means and the latent image carrying means.

12. An image forming apparatus according to claim 9, wherein the charging means includes charge applying means and means for forming a vibrating electric field between the charge applying means and the latent image carrying means; and the developer supplied to the electrostatic latent image on the surface of the latent image carrying means is oscillated by the vibrating electric field between the latent image carrying means and the charge applying means.

13. An image forming apparatus according to claim 9, further comprising housing means for accommodating the developer, wherein the latent image carrying means, the roller means and the housing means form a developer sealing means for preventing the developer leaking from the housing means.

14. An image forming apparatus according to claim 13, wherein the charging means is disposed in the housing means.

15. An image forming apparatus according to claim 13, wherein the developer in the housing means is held on the latent image carrying means by using magnetic fields provide by a magnet in the latent image carrying means and a magnet in the roller means.

* * * * *

UNITED STATES PATENT AND TRADEMARK OFFICE

CERTIFICATE OF CORRECTION

PATENT NO. : 5,434,651

DATED : July 18, 1995

INVENTOR(S) : Aizawa et al.

It is certified that error appears in the above-indentified patent and that said Letters Patent is hereby corrected as shown below:

On the title page: Item [75]

Inventors, change "Masahiro Aizawa, Takatsuki, Noboru Katakabe, Uji, both of Japan" to --Masahiro Aizawa, Takatsuki, Noboru Katakabe, Uji, Kenji Asakura, Katano, all of Japan--.

Column 4, line 17, change "2 μm" to --2mm--.

Signed and Sealed this

Nineteenth Day of December, 1995

*Attest:*

*Attesting Officer*

Bruce Lehman

BRUCE LEHMAN

*Commissioner of Patents and Trademarks*